US005143758A

United States Patent [19]

Devine

[11] Patent Number: 5,143,758

[45] Date of Patent: Sep. 1, 1992

[54] COATING BY MEANS OF A COATING HOPPER WITH COATING SLOTS WHERE THE COATING COMPOSITION HAS A LOW SLOT REYNOLDS NUMBER

[75] Inventor: William D. Devine, Chili, N.Y.

[73] Assignee: Eastman Kodak Company, Rochester, N.Y.

[21] Appl. No.: 676,950

[22] Filed: Mar. 28, 1991

[51] Int. Cl.[5] ..... B05D 1/30

[52] U.S. Cl. ..... 427/420; 118/410; 118/411; 118/DIG. 2; 118/DIG. 4

[58] Field of Search ..... 427/420; 118/DIG. 2, 118/DIG. 4, 410, 411

[56] References Cited

U.S. PATENT DOCUMENTS

| | | | |
|---|---|---|---|
| 3,508,947 | 4/1970 | Hughes | 117/34 |
| 3,920,862 | 11/1975 | Damschroder et al. | 427/131 |
| 3,928,392 | 6/1985 | Ishizaki et al. | 427/420 |
| 3,973,062 | 8/1976 | Fahrni . | |
| 4,143,190 | 3/1979 | Choinski | 427/420 |
| 4,222,343 | 9/1980 | Zimmermann et al. . | |
| 4,384,015 | 5/1983 | Koepke et al. | 427/402 |
| 4,572,849 | 2/1986 | Koepke et al. | 427/402 |

*Primary Examiner*—Shrive Beck
*Assistant Examiner*—Katherine A. Bareford
*Attorney, Agent, or Firm*—Joshua G. Levitt; William T. French; Carl F. Ruoff

[57] ABSTRACT

In the hopper coating of liquid compositions on moving webs, as in the coating of photographic layers on film supports, the trapping of solid particles or bubbles in the hopper slots causes line defects or streaks in the coated layers. These defects are avoided or reduced by determining the conditions under which the composition can be flowed through one or through a plurality of adjacent slots of the coating hopper at slot Reynolds numbers less than about 10 and flowing the composition through such slot or slots under said conditions.

7 Claims, 3 Drawing Sheets

COATING BY MEANS OF A COATING HOPPER WITH COATING SLOTS WHERE THE COATING COMPOSITION HAS A LOW SLOT REYNOLDS NUMBER

FIELD OF THE INVENTION

This invention relates to a method for coating liquid layers on a support and, more particularly to an improved method for hopper coating of photographic compositions which avoids or reduces certain coating defects.

BACKGROUND

In the coating of photographic layers on a support such as a film base or paper, a plurality of individual layers are often coated on the support simultaneously, with each successive layer being superimposed on the layer below by means of a coating hopper. One type of coating hopper, known as a multiple slide hopper, is comprised of individual slide elements which are separated by slots and cavities. By introducing each coating liquid into a cavity, the liquid stream is distributed to the desired width and then metered uniformly across the coating width by flowing through the narrow slot. Upon exiting the slot, the layer flows by gravity down the inclined slide surface. Layers of coating liquids then become superimposed on one another as layers from upstream slots flow over the layers exiting from the downstream slots. At the end of the slide surface, the liquid flows onto and coats the moving web.

A problem occurs when the narrow hopper slots become partially blocked by solid particles, gel slugs or air bubbles or when the slot surface has nicks or scratches. The flow in the vicinity of the blockage or scratch is disturbed and becomes three-dimensional. If this disturbance does not heal and the flow become two-dimensional again downstream, a deficit or longitudinal depression will develop in the layer that was delivered through the slot which contained the blockage or scratch. As the upper layers become superimposed on the layer containing the depression, they will fill in the deficit as gravity and surface tension forces act to level the top surface of the liquid layers on the hopper slide. As a result, a variation in thickness of one or several layers will occur across the width of the layers. This thickness variation of the coated layers, which is readily visible in layers having substantial optical density, creates a longitudinal streak. If sufficiently severe, the longitudinal streak destroys the value of all or part of the coated product. In the coating of photographic films and papers such streaks and lines can be a major source of waste and can add to the manufacturing costs.

The patent to Hughes, U.S. Pat. No. 3,508,947, mentions the possibility of coating a plurality of layers of the same composition in a curtain coating process (see col. 14, lines 10–23) and says that the formation of "slot lines" as occur with a single-slot extrusion-type hopper is avoided by this means. There is no suggestion, however, of any precise manner for predetermining the variables of the coating process to reduce such coating defects while achieving high coating rates. Moreover, there is no suggestion of the serious problem of streaks caused by blockages in the hopper slots. A need exists, therefore, for a method for controlling the coating procedure to reduce the severity of longitudinal streaks in the coated layers which are caused by slot blockages. The need also exists for a method for achieving high coating rates without forming severe streaks. The present invention provides such a method.

BRIEF SUMMARY OF THE INVENTION

By the method of the present invention it is possible to reduce greatly the severity of longitudinal streaks in photographic coatings caused by blockages or surface imperfections in the coating hopper slots.

This method for coating a moving support with a photographic composition by means of a coating hopper having one or more slots includes the following steps:

(a) determining the conditions for flowing said composition through slot or slots which correspond to a slot Reynolds number no greater than about 10;

(b) flowing the composition through the slot or slots under said conditions; and (c) receiving the composition flowing from the hopper on said moving support.

In a preferred embodiment said composition is flowed through a plurality of slots of a multiple slide coating hopper.

In an especially preferred embodiment, when the bottom-to-total flow rate ratio in multiple layer coating is less than about 0.5, the reduction in streak severity is particularly good when said coating composition is flowed through a plurality of slots.

THE DRAWINGS

The invention will be described in more detail by reference to the drawings, of which FIG. 1 is a schematic, partially sectional view of a multiple slide coating hopper apparatus suitable for use in the method of the invention;

DETAILED DESCRIPTION

Figure 1:
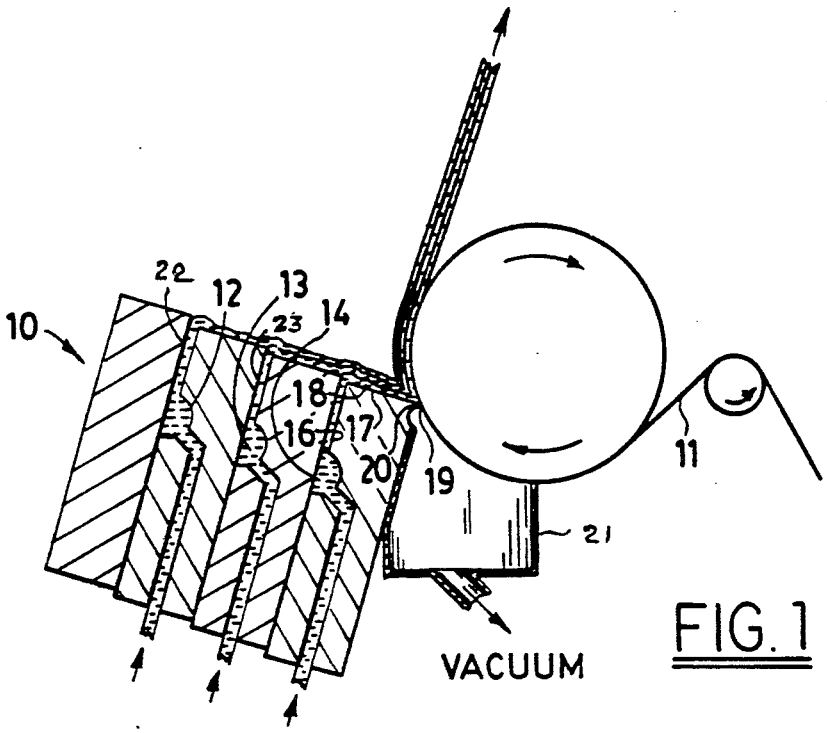

FIG. 1 illustrates the use of a multiple slide hopper 10 such as described in the patent to Mercier et al., U.S. Pat. No. 2,761,419, (incorporated herein by reference) to coat a plurality of layers of one or more photographic compositions, e.g., aqueous silver halide emulsions and the like, on a moving web of a photographic film base 11. In the conventional use of such a coating hopper, different fluid coating compositions, which form distinct separate layers on film base 11, are continuously pumped by metering or constant discharge pumps not shown in the drawing into the cavities 12, 13 and 14 respectively of the hopper 10. The composition pumped into cavity 14 is forced by the pump pressure from the cavity through a slot 16 and onto a downwardly inclined slide surface 17. The composition flows down the slide by gravity in the form of a layer 18 and into a coating bead 19 which is formed between the surface of the web 11 and the lip or end 20 of the lowermost slide surface.

The moving web 11 contacts the coating bead 19, receives the superimposed layers of coating compositions on its surface, and moves to subsequent operations such as chill setting and drying of the coatings. FIG. 1 also shows a means commonly used in bead coating, namely, a low-pressure or vacuum chamber 21 which serves to stabilize the coating bead. Such a vacuum chamber is disclosed, for example, in the patent to Beguin, U.S. Pat. No. 2,681,294, incorporated herein by reference.

The compositions pumped to cavities 12 and 13 likewise flow from slots 22 and 23 onto their respective slide surfaces and then, in superimposed relationship, over layer 18. Although shown as separate layers in the drawings, when the coating compositions flowing from slots 16, 22 and 23 are the same, there are no layer interfaces.

The bead technique of coating is known in the art, as the Mercier et al. patent shows, and is characterized by the formation of a liquid bridge or bead between the lip of the coating hopper and the surface to be coated. Although bead coating is one coating technique which employs a multiple slide coating hopper and for which the method of the present invention is applicable, it is not the only such technique. Another is curtain coating, as disclosed, for example, in the patent to Hughes, U.S. Pat. No. 3,508,947 (incorporated herein by reference). The patent discloses a multiple slide hopper having a downwardly inclined slide surface and a plurality of separate slots, the exits of which are spaced one above the other along the slide surface. The coating liquids flow from the slots and form a composite layer as they flow down the slide surface. The composite layer falls by gravity over the lower edge or lip of the hopper and forms a free-falling vertical curtain. The latter is received on a moving web or other substrate or support below the hopper.

Although the method of the invention is especially useful in reducing the severity of coating streaks in bead coating and in curtain coating with multiple slide hoppers, the method is also useful in multiple slot extrusion coating when blockages occur in the coating slots. Extrusion hoppers are well known. For example, a single slot extrusion hopper is disclosed in Beguin, U.S. Pat. No. 2,681,294, cited above, and multiple slot extrusion hoppers are disclosed in the patents to Russell, U.S. Pat. Nos. 2,761,418 and 2,761,791 and in the patent to Russell et al, U.S. Pat. No. 2,761,417, all of which are incorporated herein by reference.

In single and multiple slot extrusion hoppers, as in multiple slide hoppers, blockages in the slots can be created by solid particles, gel slugs, fibers or bubbles. These, in turn, cause streaks in the coated product. In accordance with the invention, when coating with this kind of hopper, the coating conditions corresponding to slot Reynolds numbers below about 10 are determined. Then the coating composition is passed through the slot or slots at such predetermined conditions. Although, in accordance with the invention, the severity of coating streaks can be reduced even with single slot extrusion hoppers, the invention offers particular advantages in the use of multiple slot hoppers. In such hoppers the coating composition flowing at the desired total rate is apportioned to a plurality of the hopper slots at individual coating conditions which provide the indicated low Reynolds numbers. By the combined effects of the reduced slot Reynolds numbers and the coating of the same composition in two or more superimposed layers, the severity of streaks caused by blockages in the hopper slots is markedly reduced.

Figure 2:
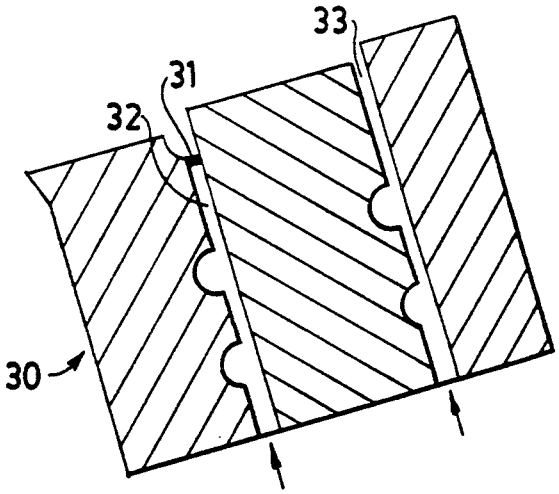
FIG. 2 is a schematic illustration of a two-slot slide hopper showing the location of a particle which blocks the flow of the coating composition in the downstream slot.

FIG. 2 illustrates diagrammatically the location of a particle or flow obstruction 31 in a two-slot slide hopper 30. Particle 31 appears at the upper end of the metering slot 32, just below the enlargement in slot 32, known as the "Padday slot", the latter being the type of slot shown in the patent to Padday, U.S. Pat. No. 3,005,440.

The severity and appearance of a streak caused by a trapped particle as in FIG. 2 will depend strongly on the location of the particle. Severe streaks are caused by particles located close to the hopper slot exit as in FIG. 2. Unfortunately, this is a location where particles are likely to be trapped.

In the method of the present invention even the severe streaks caused by particles in the slot close to the hopper slot exit can be markedly reduced while maintaining a desirable high total flow rate for the coating composition.

Figure 3:
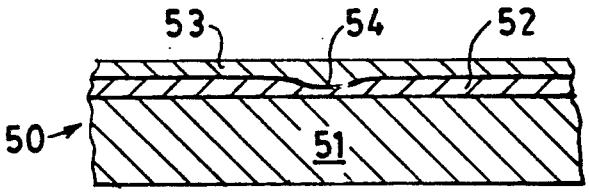
FIG. 3 is a schematic cross section of a coated film showing a coating defect in the layers.

FIG. 3 is an enlarged, diagrammatic, lateral cross-sectional view of a photographic film 50 which comprises a support 51, a layer 52 of a first photographic composition and a layer 53 of a second photographic composition. Layer 52 contains a deficit or depression 54 in the coating composition which was caused by a blockage in the slot through which layer 52 was coated. This deficit or depression is filled by the coating composition of layer 53, thus resulting in non-uniform thickness of the two layers in the vicinity of the depression. When the two layers differ in optical density the depression 54, which extends longitudially along film 50, appears as a streak in the film.

The method of the invention is based on the discovery that the severity of coating streaks caused by trapped particles or other obstacles in the slots of a coating hopper is related to the slot Reynolds number. This relationship applies to coating hoppers whether employed for bead coating or for curtain coating and whether of the slide type or extrusion type. It also applies to single slot extrusion hoppers as well as to multiple slot hoppers.

The slot Reynolds number is a dimensionless quantity that represents the ratio of inertial to viscous forces and is defined as follows:

$$\text{Slot } Re = \frac{\rho Q}{\eta} \qquad \text{(I)}$$

where $\rho$ is the fluid density, $\eta$ is the fluid viscosity and Q is the slot volumetric flow rate per unit width. In this equation the variables are in a consistent system of units, whether metric or English in order to produce a number such as 10 having no units. See *Chemical Engineers Handbook*, 5th Edit., Perry et al, McGraw-Hill Book Co., pp. 2–81 to 2–84.

In accordance with the present invention it has been found that when the slot Reynolds number, as defined above, exceeds about 10, the streaks caused by slot blockages become increasingly severe and are not healed by coating layers over the streaked layer or otherwise.

Furthermore, it has been found that high Reynolds numbers, i.e. greater than about 10, will increase the likelihood that a line or streak in the coating will be severe enough to create waste and that even particles deep in the hopper slots will cause streaks. At high Reynolds numbers, extremely small particles or even minute hopper imperfections can cause lines.

To provide the coating conditions which correspond to a slot Reynolds number no greater than about 10 in the method of the invention, the flow rate or the viscosity of the liquid coating composition can be adjusted. Although fluid density is also a variable condition as equation I shows, little or no latitude is available for changing the density of photographic coating compositions. As for viscosity, solids or water can be added or removed. These measures can create problems, however. Adding solids can add to cost, increase layer thickness or adversely affect photographic properties of a layer while removing water to increase viscosity can create solubility problems and adversely affect coating in other ways.

Several bead coating tests have been carried out which demonstrate the unexpected reduction in coating defects obtainable by the method of the invention. In order to make any coating streaks visible, a mixture of gelatin and a carbon slurry was used as the coating composition for the slot containing an obstruction and the top coat was a clear layer. These tests are described as follows:

Test 1

The coating hopper was a two-slot slide hopper as in hopper 30 of FIG. 2 of the drawings. Its slot height was 0.010 in. and the slide angle was 15°. A blockage 31 was purposely placed in the downstream slot 32 by adhering a small plastic disk (0.010 in. thickness and 0.062 in. diameter) at a position 0.15 in. from the slot exit. A series of coatings was made on moving film webs. For each coating, the bottom layer was formed by flowing an aqueous gelatin-carbon slurry mixture through the slot containing the blockage. Three different bottom layer compositions were coated, having viscosities at the coating temperature of 105° F. of 2.8, 5.9 and 9.0 cP, respectively. To form the top layer, a clear aqueous solution of gelatin and an ionic surfactant was flowed through the upstream slot 33. Three different clear top layer compositions were employed, having viscosities of 3.2, 6.2 and 9.8 cP, respectively. A series of coatings was made in this manner at different flow rates per unit slot width. For the gelatin/carbon mixture of the bottom layer the flow rates ranged from 0.42 to 1.26 cc/cm-sec and, for the gelatin/surfactant composition of the top layer, from 0.06 to 0.36 cc/cm-sec. The coated films were dried in conventional manner and the severity of the streak formed in the coatings was measured by densitometric analysis. Streak severity is defined as the peak-to-peak optical density variation in the vicinity of the streak divided by the mean density of the coating. For the gelatin-carbon mixture (used in one layer only) the measured variation in optical density closely approximates the variations in layer thickness.

Figure 4:
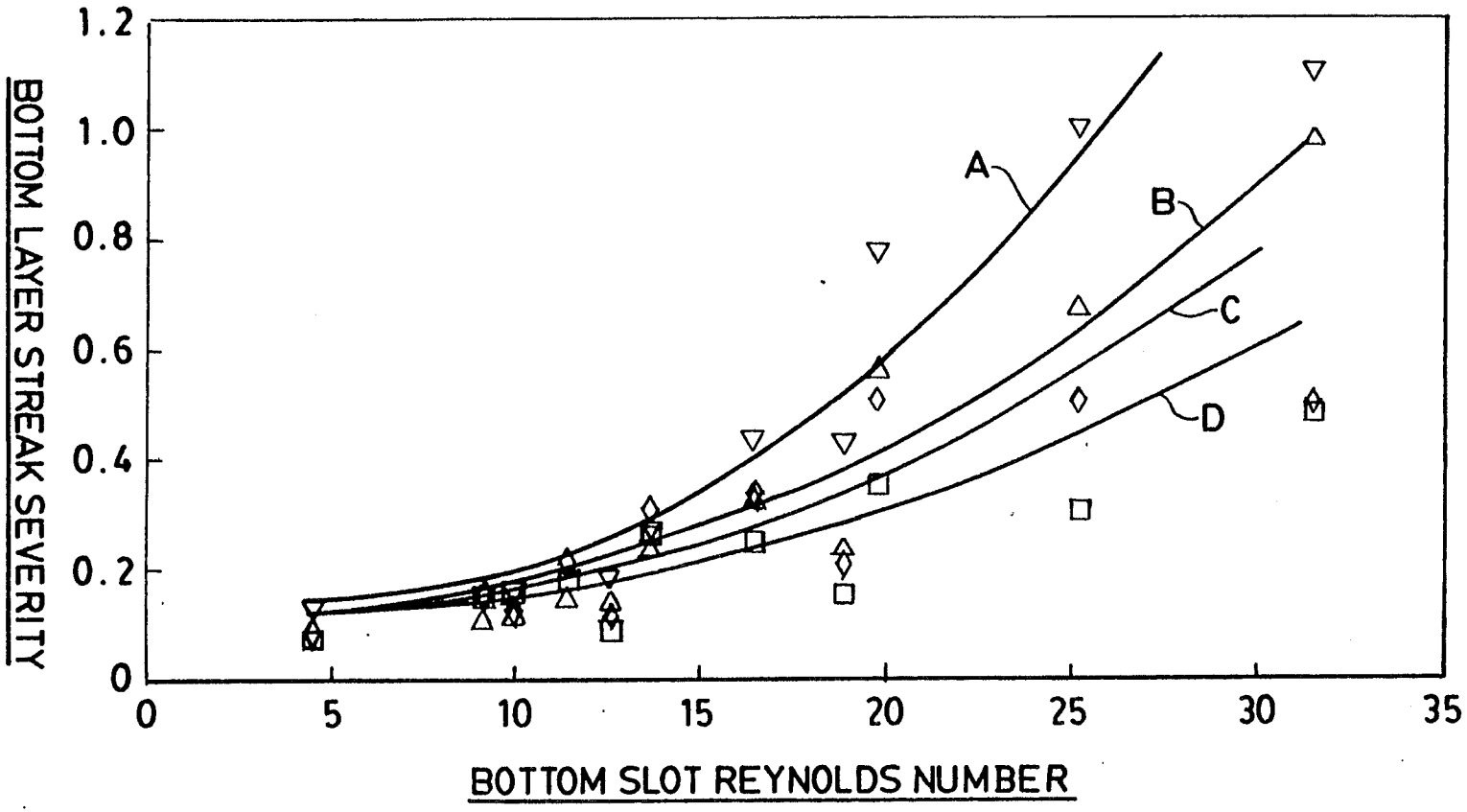
FIG. 4 is a plot of data showing the relationship between streak severity and slot Reynolds numbers.

FIG. 4 of the drawings plots the results of these tests in terms of the severity of the streak formed in the dried bottom layer versus the calculated Reynolds numbers for the bottom layer at the different flow rates employed. Curves are plotted for each of four different top layer flow rates. As each of the curves A, B, C and D of FIG. 4 show, the severity of the streak increased substantially as the Reynolds number for the bottom slot increased above about 10. When the Reynolds number was below about 10, further reduction in the Reynolds number did not appreciably change the streak severity.

The test results of FIG. 4 demonstrate another characteristic of the method of the invention. They show that when the flow rate of the top layer decreases, the effect of reduction in Reynolds number for the bottom layer is less pronounced. Thus, the invention can be of particular value when several layers (e.g., 8 or more) are coated simultaneously and a layer containing a blockage, therefore, is a small fraction, e.g., less than about 0.5 and especially when less than about 0.2, of the total flow rate. A possible explanation is that when the flow rate of the bottom layer is relatively large as compared with the top layer, the bottom layer tends to act as a single layer. Accordingly, the streak in the bottom layer has a stronger tendency toward self-healing and increase in the Reynolds number does not increase the severity of the streak as greatly as when the ratio of top layer to the bottom layer is relatively high. This is believed to explain the difference, e.g., between curves A and D of FIG. 4. Thus, in curve A the top layer flow rate was relatively high and, hence, the ratio of bottom layer to total was relatively low. In this case, increases in Reynolds number of the bottom layer (where the obstruction was) greatly increased the severity of the streak. In curve D, on the other hand, the bottom layer formed a greater part of the total coating and the effect of Reynolds number on the streak was less severe although still quite significant.

The ratio of the top layer to the bottom layer, as mentioned above, is referred to herein and in the claims as the bottom-to-total flow rate. This means the ratio of the volumetric flow rate of the bottom layer to the total volumetric flow rate of the combination of layers including the bottom layer and all layers above it. In this usage, the bottom layer means the layer in which the slot obstruction occurs. It may, in fact, have other layers below it.

Test 2

In a coating hopper containing two slots as in FIG. 2, scratches were purposely machined into the entire length of the upstream side of the downstream slot. The scratches were parallel to the direction of flow and their depth was approximately 0.0002 inch. Gelatin-carbon slurry mixtures having viscosities in the range from 3.0 to 9.2 cP were flowed through the downstream slots at different rates ranging from 0.42 to 0.84 cc/cm-sec. An aqueous solution of gelatin and surfactant (viscosity = 19 cP) was flowed through the upstream slot at different rates varying from 0.06 to 0.63 cc/cm-sec. Films were coated at four different ratios of bottom-to-total layer wet coverage, namely, 0.56, 0.63, 0.74 and 0.88. Reynolds numbers were calculated for the bottom layer flow. For all four ratios of bottom-to-total layer wet coverage, the films coated at Reynolds numbers above 10 (specifically at Re = 14, 21 and 28) contained unacceptable coating streaks. For those coated at Reynolds numbers below 10 (specifically, 4.6 and 9.1) streaks were either absent or were markedly reduced in severity.

In accordance with the present invention, slot Reynolds numbers lower than 10 can be achieved even at high total coating rates and low viscosities by increasing the number of slots through which the photographic composition is flowed. Flowing the composition through a plurality of slots will reduce the volumetric flow rate per unit width for each slot. The total volumetric flow rate will remain constant, however. As equation I shows, reducing the volumetric flow rate per unit width reduces the Reynolds number. For example, when a fluid is flowed through two slots instead of one at the same total rate, the Reynolds number in each slot is reduced by a factor of approximately 2. The following test demonstrates the advantage of flowing a photographic composition through a plurality of hopper slots.

Test 3

A slide hopper having four slots was used to bead coat the same types of coating compositions as in the previous tests. Coatings were made at one volumetric flow rate per unit width for the bottom layer but at four different flow rates for the top layer. This gave four different values for the bottom-to-total flow rate ratio. For one coating the bottom layer (gelatin and carbon slurry) was flowed through only one slot. The Reynolds number was 20. Two blockages of the type described in Test 1 were placed in the slot. The dried coating for each bottom-to-total flow rate ratio exhibited severe streaks. The bottom layer composition was then flowed at the same total flow rate through two adjacent slots. Dramatic reductions occurred in the streak severity as the Reynolds number in each slot was thus lowered to about 10. In fact, the streaks were essentially imperceptible at the Reynolds number of about 10 when the bottom-to-total flow rate fraction was 0.8 and 0.9. Coatings were also made by flowing the gelatin-carbon slurry mixture for the bottom layer through three slots. Further reductions in the severity of streaks were observed. In fact, the streaks were not perceptible in any of the dried coatings made at five different bottom-to-total layer flow rates.

In general, when flowing a coating composition through a plurality of hopper slots, the more severe streaks will be formed by blockages located in the most upstream of the slots. In Test 3, in order to provide the most severe test, the blockages were placed in the most upstream slot through which the gelatin-carbon composition was flowed. Even under this condition the streaks were eliminated or markedly reduced in severity.

Test 3 shows a great advantage for flowing a composition through more than one hopper slot when the Reynolds number for the same total flow rate through a single slot would exceed 10. Reductions of streak severity of 10-fold or more are possible. When the Reynolds number is less than 10 there is still some advantage to flowing a composition through more than one slot, although any reduction in streak severity will be less than when the Reynolds number is high. The advantage is in the fact that the disturbance caused by a blockage will initially be confined to only a fraction of the total layer of that composition. This disturbance confinement effect is independent of the Reynolds number. However, when the Reynolds number is low, the disturbance confinement effect may be significantly offset by a reduced healing of the streak on the hopper slide by the surface tension and gravity forces. These forces are more effective in partially healing a streak in a layer on the hopper slide when the volumetric flow rate fraction of the layer is high.

Although the method of the invention provides its most notable reduction in streak severity when the slot Reynolds numbers is reduced to below about 10, e.g., in the range from about 8 to about 10, at low Reynolds numbers, e.g., from about 0.1 to 5, the streak severity is also very low, provided that the ratio of the bottom-to-total flow rate is relatively low, i.e., less than about 0.5. When the bottom-to-total flow rate ratio is greater than about 0.5 it is possible for an increase in the number of slots to cause somewhat of an increase in streak severity. This characteristic is demonstrated by a test carried out as follows:

Test 4

A multiple slide coating hopper was employed for coating three-layers using the coating compositions and at the viscosities and flow rates per unit width as follows:

| Composition: | Bottom Layer Aqueous Gelatin | Middle Layer Aqueous Gelatin/ Carbon Slurry | Top Layer Aqueous Gelatin/ 0.08 Vol. % Surfactant |
|---|---|---|---|
| Viscosity: (cP) | 5.2 | 37.6 | 36.3 |
| Flow rate: (cc/cm-sec) | 0.94 | 0.43 | 0.11 and 1.0 |

In these tests a blockage, as previously described, was placed at 0.125 inch from the exit of the most upstream slot for the middle layer. The middle layer composition flowed through one, two or three slots at flow rates corresponding to a Reynolds number of about 1. The clear top layer flowed at two rates, as indicated above, to provide bottom-to-top flow rate ratios of 0.30 and 0.80.

Figure 5:
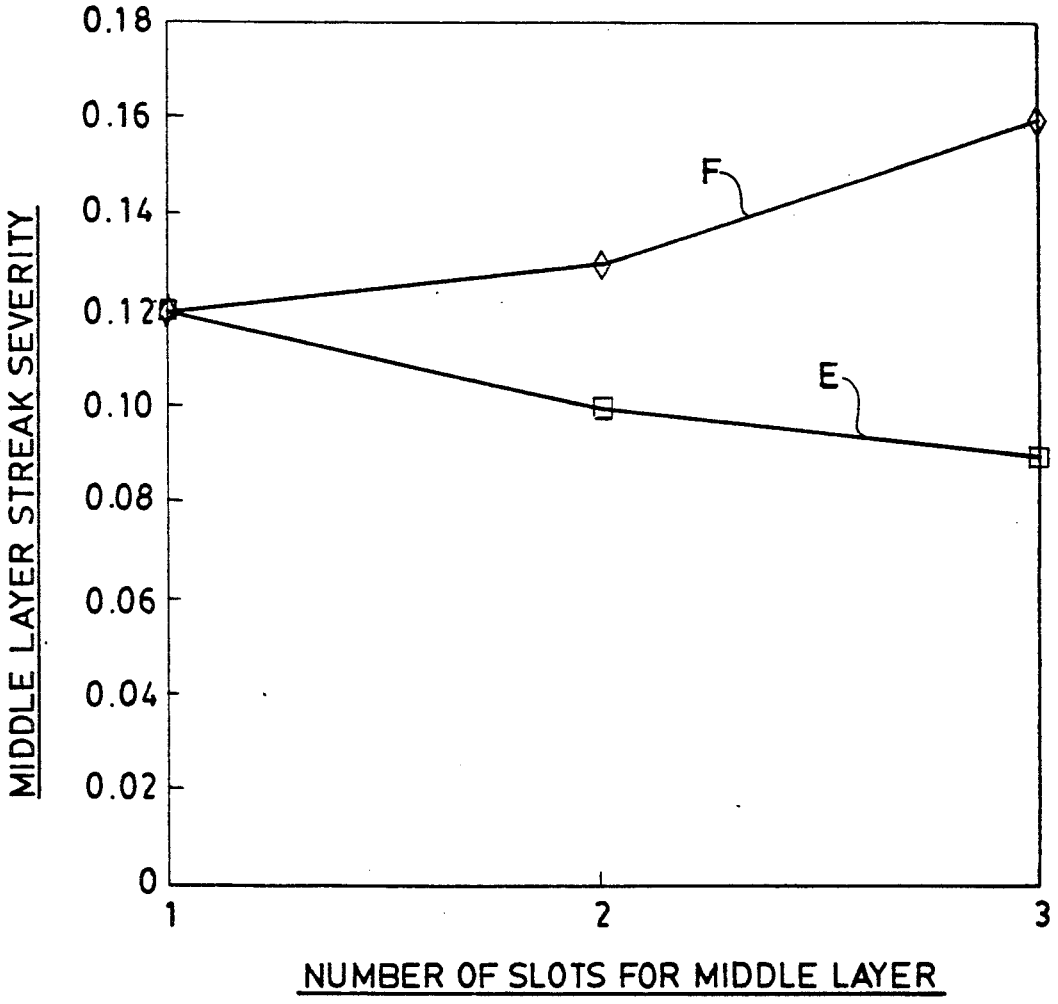
FIG. 5 is a plot of data showing the relationship of streak severity to the number of coating slots at different slot Reynolds numbers.

The results of these tests are shown by curves E and F of FIG. 5. Curve E plots the streak severity for the three coatings in which the middle layer flowed through one, two or three slots and the bottom-to-top flow rate ratio was 0.30. Curve F similarly plots the streak severities for the flow ratio of 0.80. From these results it can be concluded that at such a low Reynolds number (Re=1) for the layer containing an obstruction, the disturbance confinement effect, which results from flowing the composition through more than one slot, is more effective when the flow ratio of the layer containing the slot blockage is below about 0.5. As curve F shows, when this ratio is high (0.8) diversion of the flow to two or three slots does not reduce the streak severity and may even increase it.

The data of FIG. 5 further indicate that when the bottom-to-total flow rate ratio is below about 0.5, there is a significant streak severity reduction advantage, even at Reynolds numbers much lower than 10, when passing a coating composition through more than one slot. The maximum reduction in streak severity from the disturbance confinement effect occurs when the bottom layer is very thin, i.e., bottom-to-total flow rate ratio is very low, e.g., below about 0.2. In this case, the reduction in streak severity approaches the theoretical maximum of being proportional to the ratio of the increase in the number of slots for the layer. For example, two slots would reduce the streak severity by about 50 percent as compared with one slot.

In the above-described tests the streak severity has been measured in products having a clear layer coated over a carbon-containing layer the latter having been coated through a slot which contained a blockage. In that case the deficiency or depression in the partially blocked layer is clearly visible as a streak or line. In general, however, steaks and lines will appear whenever the blockage occurs in a layer formed of a composition which has an optical density substantially different from that of any layer coated over it.

As indicated, the method of this invention is useful in the manufacture of multilayer photographic elements, i.e., elements comprised of a support coated with a plurality of superimposed layers of photographic coating compositions. The number of layers may range from two to as many as ten or more. The liquid coating compositions are of relatively low viscosity, e.g., having viscosities from as low as about 2 centipoises to as high as about 200 centipoises, or somewhat higher, at the coating temperature. Most commonly the viscosity is range from about 5 to about 150 centipoises. The individual layers applied are exceedingly thin, i.e., a wet thickness which is a maximum of about 0.015 centimeter and generally is far below this value and may be as low as about 0.0001 centimeter. In addition the layers are required to be of extremely uniform thickness, the maximum variation in thickness uniformity being plus or minus five percent and in some instances as little as plus or minus 0.2 percent.

The term "photographic" normally refers to a radiation sensitive material, but not all of the layers applied to a support in the manufacture of photographic elements are, in themselves, radiation sensitive. For example, subbing layers, pelloid protective layers, filter layers, antihalation layers, etc. are often applied separately and/or in combination and these particular layers are not radiation sensitive. The term "photographic coating composition" is intended to include the compositions from which such layers are formed.

While the layers are generally coated from aqueous media, the invention is not so limited since other liquid vehicles are known in the manufacture of photographic elements and the invention is also useful in coating from such non-aqueous liquid vehicles.

More specifically, the photographic layers coated according to the method of this invention can contain light-sensitive materials such as silver halides, zinc oxide, titanium dioxide, diazonium salts, light-sensitive dyes, etc., as well as other ingredients known for use in photographic layers, for example, matting agents such as silica or polymeric particles, developing agents, mordants, and materials such as are disclosed in U.S. Pat. No. 3,297,446. The photographic layers can also contain various hydrophillic colloids. Illustrative of these colloids are proteins, e.g., gelatin; protein derivatives; cellulose derivatives; poly-saccharides such as starch; sugars, e.g., dextran; plant gums; synthetic polymers such as poly(vinyl alcohol), poly(acrylamide), and poly(vinylpyrvolidone); and other hydrophillic colloids such as are disclosed in U.S. Pat. No. 3,297,446. Mixtures of the aforesaid colloids may also be used.

In the method of the invention, various types of photographic supports may be used. These include film base, e.g., cellulose acetate film, poly(vinyl acetal) film, polycarbonate film, poly(ethyene terephthalate) film and other polyester films. Paper supports coated with alpha-olefin polymers, e.g., exemplified by polyethylene and polypropylene, or with other polymers, such as cellulose organic acid esters and linear polyesters, may also be used. The support can be in the form of a continuous web or in the form of discrete sheets, but in commercial practice it will most frequently take the form of a continuous web.

Various types of surfactants can be used to modify the surface tension and coatability of the photographic coating compositions. Useful surfactants include saponin; non-ionic surfactants such as polyalkylene oxides, e.g., polyethylene oxides, and the water-soluble adducts of glycidol and alkyl phenol; anionic surfactants such as alkylaryl polyether sulfates and sulfonates; and amphoteric surfactants such as arylalkyl taurines, N-alkyl and N-acyl beta-amino propionates; alkyl ammonium sulfonic acid betaines, etc. Illustrative examples of useful surfactants are disclosed in British Patent 1,022,878 and in U.S. Pat. Nos. 2,739,891; 3,026,202 and 3,133,816.

The invention has been described in detail with particular reference to preferred embodiments thereof, but it will be understood that variations and modifications can be effected within the spirit and scope of the invention.

I claim:

1. The method for coating a photographic composition on a moving support by means of a coating hopper having one or more coating slots which comprises:

(a) determining the conditions for flowing said composition through said slot or slots which correspond to a slot Reynolds number no greater than about 10;

(b) flowing said composition through said slot or slots under said conditions; and (c) receiving said composition flowing from the coating hopper on said moving support.

2. The method according to claim 1 wherein the coating hopper has a plurality of slots, which further comprises:

(a) determining the total flow rate for the composition which is required to form a layer thereof of a predetermined thickness on the support;

(b) determining the individual flow rates for each of said slots which correspond to a slot Reynolds number no greater than about 10 for each slot;

(c) determining the number of slots through which the composition must be flowed at said individual flow rates to provide said total flow rate;

(d) Passing the composition through the determined number of adjacent slots; and from the coating hopper on said moving support.

3. The method according to claim 2 wherein the slot Reynolds number is in the range from about 8 to about 10.

4. The method according to claim 2 wherein said composition is passed through a plurality of slots to form superimposed layers including a bottom layer and wherein the ratio of the flow rate of said bottom layer to the total flow rate is less than about 0.5.

5. The method according to claim 4 wherein the slot Reynolds number is less than about 1 and said composition is flowed through a plurality of slots.

6. The method for coating a moving support with a photographic composition which comprises:

(a) providing a coating hopper having a plurality of slots and downwardly inclined slides;

(b) determining the total flow rate for the composition which is required to form a layer thereof of a predetermined thickness on the support;

(c) determining individual flow rates for each of said slots which correspond to a Reynolds number no greater than about 10 for each slot;

(d) determining the number of slots through which the composition must be flowed at said individual flow rates to provide said total flow rate;

(e) passing the composition through the determined number of adjacent slots whereby the composition flows down the slides of the hopper; and (f) receiving the composition flowing off of the lowermost hopper slide on said moving web.

7. The method for coating a liquid photographic composition on a moving support by means of a multiple slot coating hopper and controlling the severity of streaks potentially caused by slot blockages which comprises determining a total flow rate of the liquid composition necessary to form a continuous layer thereof of predetermined thickness on the moving web, determining the individual slot flow rate for each slot of the coating hopper which provides a Reynolds number no greater than about 10, in accordance with the equation $$Re = \frac{\rho Q}{\eta}$$

wherein Re is the dimensionless slot Reynolds number, $\rho$ is the fluid density of the coating composition, $\eta$ is the fluid viscosity of the coating composition and Q is the slot volumetric flow rate per unit of width, flowing said composition through each slot at a rate equal to or less than said individual flow rate for the slot, flowing the coating composition through a sufficient number of adjacent slots of the coating hopper to provide said total flow rate, and receiving the composition flowing from the coating hopper on said moving web.

* * * * *